US005090346A

United States Patent [19]

Goldman

[11] Patent Number: 5,090,346

[45] Date of Patent: Feb. 25, 1992

[54] MULTI-PART SHIP CONSTRUCTION SYSTEM

[76] Inventor: Jerome L. Goldman, 935 Gravier St., New Orleans, La. 70112

[21] Appl. No.: 537,562

[22] Filed: Jun. 12, 1990

[51] Int. Cl.[5] ..... B63B 3/04

[52] U.S. Cl. ..... 114/77 R; 114/248

[58] Field of Search ..... 114/65 R, 65 A, 77 R, 114/248, 352

[56] References Cited

U.S. PATENT DOCUMENTS 3,447,503 6/1969 Myers ..... 114/65 R 3,675,606 7/1972 Takezawa ..... 114/65 R

FOREIGN PATENT DOCUMENTS 2053807 11/1981 United Kingdom ..... 114/248

*Primary Examiner*—Sherman Basinger

*Attorney, Agent, or Firm*—Keaty & Keaty

[57] ABSTRACT

A construction system for ships utilizing three basic units which are attached together to form an integrated streamlined hull design suitable for navigation. The hull unit has an open area or slot in the stern portion with two side arms or wings into which the propulsion unit is placed and to which the propulsion unit is securedly attached. The accommodation/navigation unit is fixedly attached to the deck of the propulsion unit and secured by self hardening material, such as concrete, polyurethane and the like. The basic three units are originally constructed as independent units and are integrated in accordance with ship's specifications to be used as cargo vessels or passenger vessels.

7 Claims, 2 Drawing Sheets

MULTI-PART SHIP CONSTRUCTION SYSTEM

BACKGROUND OF THE INVENTION

The present invention relates to a construction system for marine vessels, and more particularly to a construction system, wherein the vessel is constructed of separate parts, which are joined together to form an integral vessel.

It has been a well developed and accepted practice to design and construct a ship as a one-piece integral unit having a single hull within which the propulsion unit, cargo holding compartments and/or passenger cabins are located. Such method involves the welding together of steel plates to form a floatable hull suitable for cargo transportation or for passenger accommodations. The cost of construction is usually high and virtually all construction is accomplished at a single shipyard.

The present invention contemplates provisions of a considerably less costly method and system of a vessel construction, wherein three major parts of the ship, that is a hull, a propulsion unit and an accommodation/navigation unit, are manufactured as separate units and assembled together to form a floatable unit.

SUMMARY OF THE INVENTION

It is therefore an object of the present invention to provide a construction system and method for marine vessels, allowing considerable reduction in the cost of manufacturing of the vessel.

It is a further object of the present invention to provide a system, wherein the major parts of the vessel can be constructed at various locations and then assembled together at a shipyard.

It is still a further object of the present to provide a system, wherein the propulsion unit is made not to be seaworthy.

It is still a further object of the present invention to provide a marine vessel construction system, wherein the multiple parts forming the marine vessel unit are joined together to form a single integrated ship.

This and other objects of the present invention are achieved by provision of a three-part construction system for ships which provides for separate manufacture of a primary cargo/passenger carrying hull, a propulsion unit and an accommodation/navigation unit.

The marine vessel in accordance with the present invention comprises three basic parts: a floatable hull unit, an independently non-floatable propulsicn unit and an accommodation/navigation unit, all basic units being attachable together to form a streamlined ship. A U-shaped cutout is formed in the stern portion of the hull unit which extends vertically through the entire height of the hull unit. The propulsion unit has a periphery which is sized and shaped to fit within the U-shaped cutout of the stern portion. Opposing parallel side walls forming the U-shaped cutout of the stern portion are provided with longitudinal horizontal grooves and the corresponding facing side walls of the propulsion unit are formed with elongated protuberances extending outwardly from the vertical walls of the propulsion unit, the protuberances being sized and shaped to fit within the grooves of the stern portion of the hull unit. Once the propulsion unit is positioned in such a manner that the protuberances are engaged within the grooves of the stern portion, the space gap between the propulsion unit and the hull unit is filled with concrete, which when hardens, securedly attaches the propulsion unit to the hull unit.

In order to prevent spreading of the side walls forming the U-shaped cutout in heavy sea conditions, bracing rods are employed which extend into corresponding openings within the facing side walls of the propulsion unit and the stern portion of the hull unit. The bracing rods are incased in an enclosure which is subsequently filled with concrete or other hardening material. The accommodation/navigation unit is attached to the deck of the propulsion unit or to the deck of the hull unit, depending on the particular design of the vessel, by a securing means, which comprise a horizontal flange extending about the periphery of the accommodation/-navigation unit perpendicularly to the vertical walls of the unit. An L-shaped bar is secured to the deck of the unit (hull unit or propulsion unit) to which the accommodation/navigation unit is to be attached a distance from the horizontal flange and the space between the flange and the L-shaped bar is filled with concrete or other selfhardening material.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
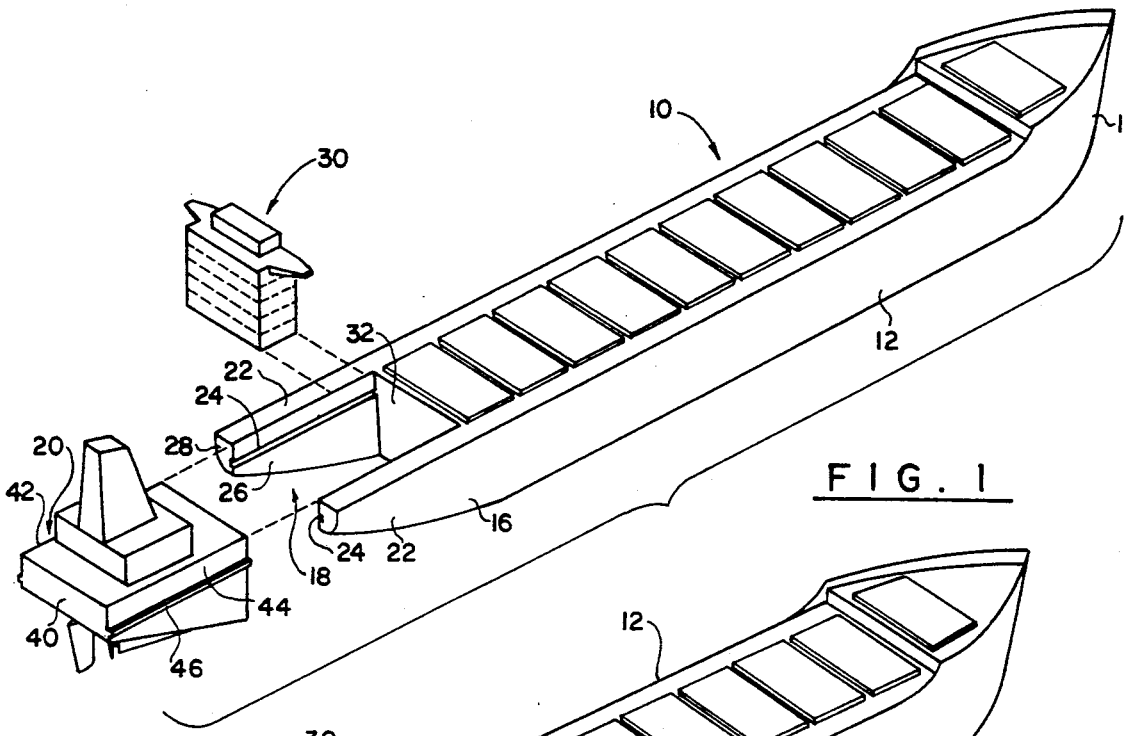
FIG. 1 is a schematic exploded view of the basic three parts forming the vessel in accordance with the present invention.
Figure 2:
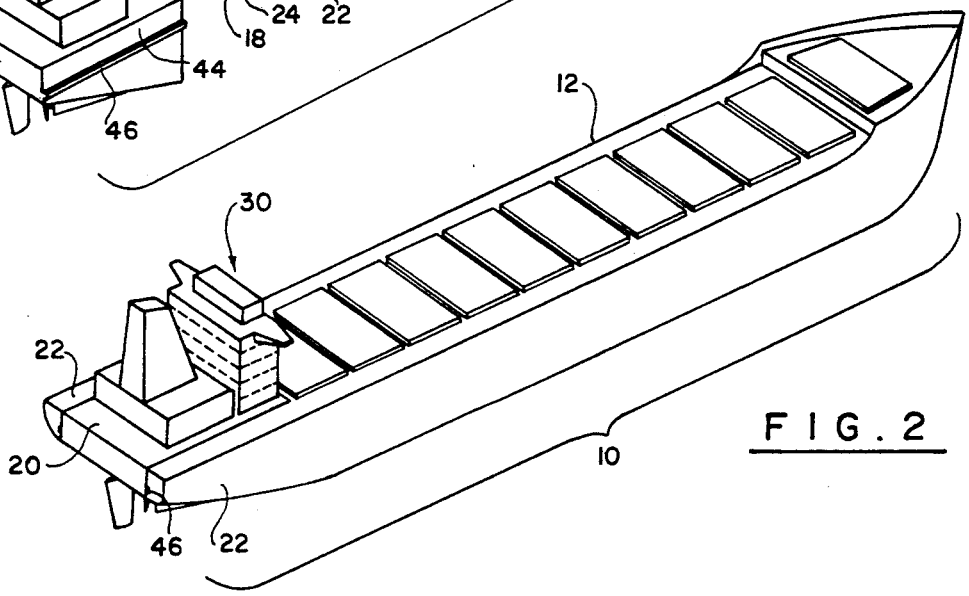
FIG. 2 is a perspective schematic view similar to the view of FIG. 1, showing the ship in an assembled condition.

Referring now to the drawings in more detail, and in particular to FIGS. 1 and 2, the marine vessel of the present invention is generally designated by numeral 10. As can be seen in the drawings, the vessel 10 comprises a cargo unit 12, a propulsion unit 20 and an accommodation/navigation unit 30.

The hull unit 12 is substantially similar in construction to conventional hulls of a ship having a bow portion 14 and a stern portion 16 The stern portion 16 has a U-shaped cutout 18 extending through the height of the hull 12 and defined by a pair of side arms 22, contiguous on the exterior with the side walls of the cargo unit 12. The side arms 22 are each formed with elongated slot 24 which extends along the inner faces 26 of the side arms 22 from the outermost end 28 towards the inner wall 32 which forms the forward most end of the U-shaped cutout 18 and also defines the cutout 18.

Figure 6:
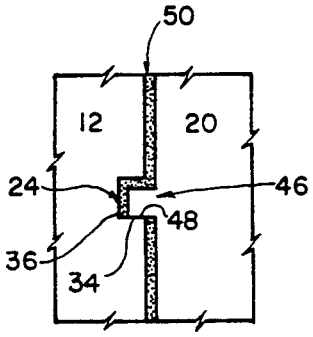
FIG. 6 is a detail view illustrating interfacing between the cargo hull unit and the propulsion unit with concrete securing the connection.

As can be seen in FIG. 6, the grooves 24 have a generally rectangular configuration having a bottom surface 34, a side wall 36 and a top surface 38.

The propulsion unit 20 has a general width not greater than the width of the cutout 18, so that it can fit within the cutout 18, and the outermost vertical wall 40 of the propulsion unit 20 is substantially on the same plane as the outermost end 28 of the side arms 22, when the unit 12 and 20 are integrated.

The propulsion unit 20 has vertically extending side walls 42 and 44, each of which is provided with rectangular protrusion or extension 46, extending outwardly from the side walls 42 and 44. The protrusions 46 are sized and shaped to fit within the grooves 24 of the side arms 22 and rest therein when the vessel 10 is being assembled During such assembly, the propulsion unit 20 is moved by conventional means into the cutout 18 and the bottom surface 48 of the protrusion 46 is allowed to rest on the bottom surface 34 of the groove 24, in the manner illustrated in FIG. 6. A space, for example two (2) inches gap, is left between the facing walls of the cargo unit 12 and the propulsion unit 20, the gap 50 between the facing walls is filled with liquid concrete or other similar material, which when hardened, provides a joining force between the cargo hull 12 and the propulsion unit 20. A temporary form of plywood or other material is supported around the bottom of the unit and the vertical gap at the transom of the stern and is removed once the concrete hardens.

Figure 7:
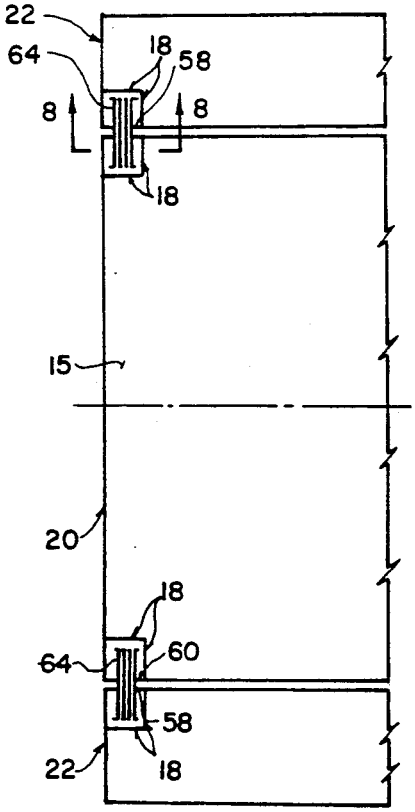
FIG. 7 is a top plan detail view illustrating the manner of secondary attachment means of the cargo unit and the propulsion unit.
Figure 8:
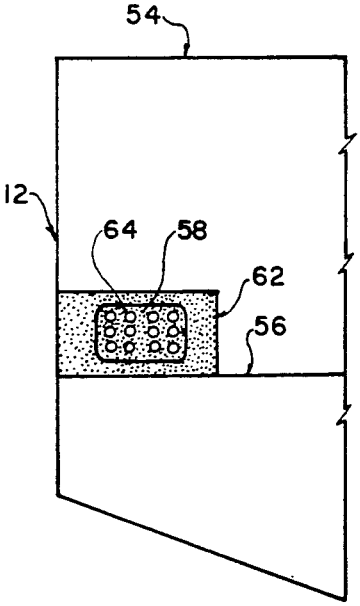
FIG. 8 is a detail sectional view taken along lines 8—8 of FIG. 7.

The motion of a ship in heavy seas can be very severe and it is possible for the side arms 22 of the cargo unit 12 to have a tendency to spread apart. The concrete used to fill in the gap 50 cannot be depended upon to take any extension force, which such spreading action might cause. To take such tension forces, the side wall 22 must be secured to the propulsion unit 20 at both sides. To provide for such secondary securing means, the present invention utilizes steel reinforcing rods as better illustrated in FIGS. 7 and 8. As can be seen in FIG. 8, the cargo unit 12 has a main or weather deck 54 and a second, lower deck 56. A rectangular cutout 58 is formed in the hull 12 at a level of the second deck 56 adjacent facing walls of the side arms 22. A matching opening 60 is formed in co-aligned relationship in the wall of the propulsion unit 20, on both sides thereof, as illustrated in FIG. 7. Securedly positioned on the deck 56 is an enclosure 62 having an open top. The enclosure 62 can be a steel box welded to the deck 56. A plurality of steel reinforcing rods 64 are positioned in spaced relationship within the openings, or cutouts 58 and 60 after the propulsion unit 20 has been positioned in its predesigned place within the cutout 18 of the hull unit 12. The reinforcing rods 64 are aligned to extend midway into the opening 58 and midway into the opening 60, respectively. Concrete is deposited around the rods 64 to secure their position within the cutouts 58 and 60. The enclosures 62 are likewise filled with concrete, or similar hardening material, which upon setting provides a permanent strong tension connection between the hull unit 12 and the propulsion unit 20, resisting and withstanding any spreading action of the side arms 22 in heavy seas.

Figure 9:
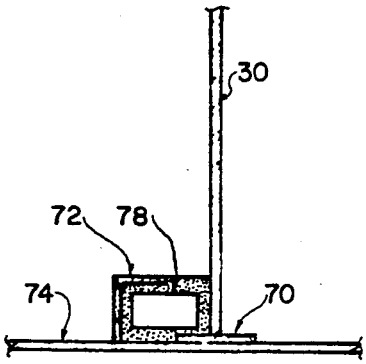
FIG. 9 is a cross sectional view illustrating a detail of attachment of the propulsion unit and the accommodation/navigation unit.

The accommodation/navigation unit 30 can be secured to the propulsion unit 20 prior to the latter engagement with the hull unit 12. It is a conventional practice to build the unit 30 as a selfsupporting module. In order to ensure fixed connection between the propulsion unit and the unit 30, the vertical exterior walls of the unit 30 are provided with a horizontal flange 70 which extends about the periphery of the unit 30 perpendicularly to the vertical walls thereof and at the bottom portion thereof. The flange 70 extends halfway inside the unit 30 and halfway outside of the vertical wall as can be better seen in FIG. 9.

An L-shaped angular bar 72 is fixedly secured, such as by welding, to the upper deck 74 of the propulsion unit 20 at the forward portion thereof. The angular bar 72 extends about the periphery of the propulsion unit 20 a distance from the outwardly extending portion 76 of the horizontal, or transverse flange 70. Thus, a space is formed between the angular bar 72 and the propulsion unit 20. Concrete, or other similar material, is deposited into that space, securedly attaching the accommodation navigation unit 30 to the deck of the propulsion unit 20. To further ensure fixed connection between the two units, steel sheer lugs 78 are placed at intervals in the space between the angular bar 72 and the transverse flange 70. The concrete deposits itself around the lugs 78 to prevent any uplifting forces or horizontal forces to break the attachment between the propulsion unit 20 and the accommodation/navigation unit 30.

Recent developments in concrete materials include a method of adding fibrous materials to the dry mixture. Such concrete demonstrates suitable tension and flexural properties, as well as the usual compressive strength. The above described attachment method can utilize such concrete.

All electrical and piping connections between the units 12, 20 and 30 are formed in a conventional manner and do not form a part of the present invention.

The present invention contemplates that the propulsion unit 20 is not intended to float as an independent body. When not resting within the cutout 18 of the hull unit 12, the propulsion unit 20 is supported by external means, such as for example a cradle or dry dock which can be found at conventional ship yards. The propulsion unit 20 can also be rolled onto a U-shape floating dock and thus carried to the cargo hull 12. The dock is then flooded until the propulsion unit 20 can be pushed into its predetermined place, then the dock is lowered, and removed from its position supporting the propulsion unit 20.

Figure 3:
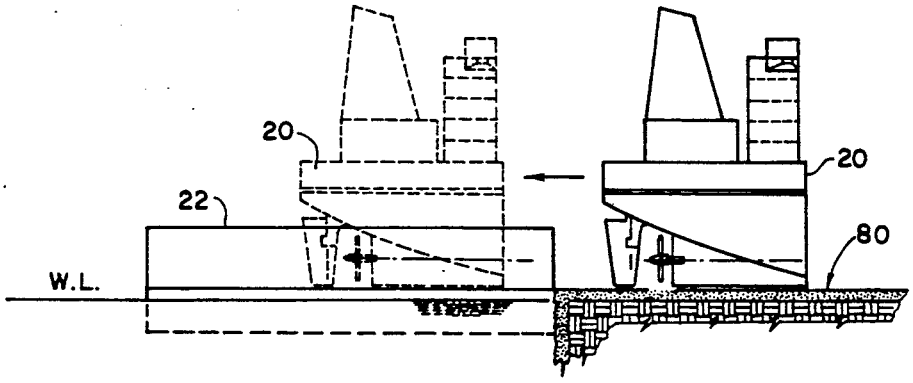
FIG. 3 is a schematic view illustrating movement of a propulsion unit from a land-based building ways to a dry dock.
Figure 4:
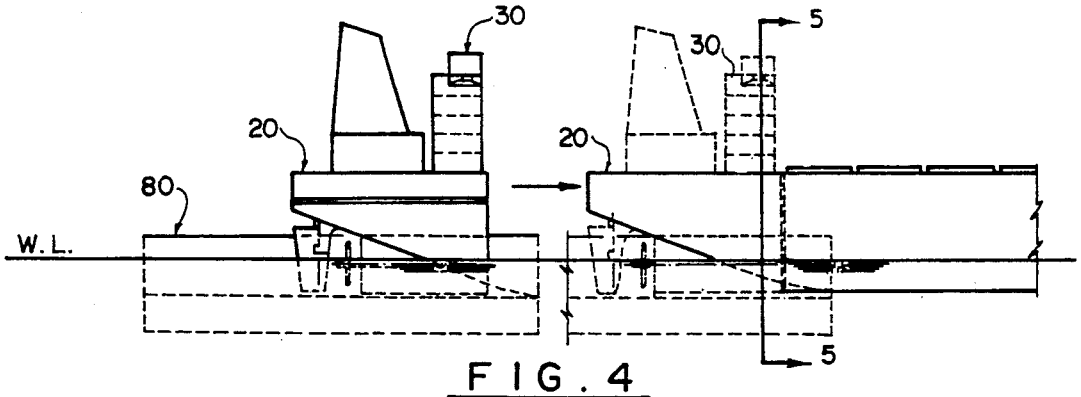
FIG. 4 is a schematic view illustrating integration of the propulsion unit with the cargo hull unit.
Figure 5:
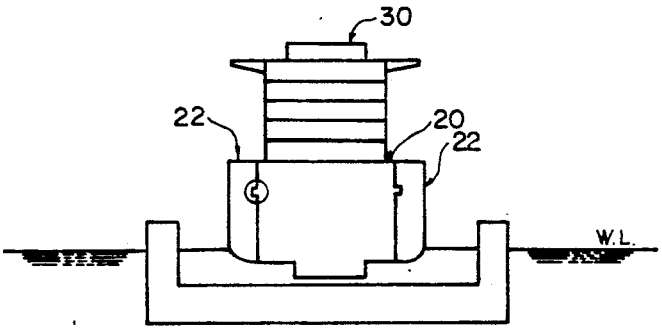
FIG. 5 is a sectional view taken along lines 5—5 of FIG. 4.

Referring to FIGS. 3 through 7, and exemplary method of assembly of the propulsion unit 20 into the stern of the basic cargo unit 12 will be described. Initially, the propulsion unit 20 is built and is substantially completed at a construction site, not necessarily at the same site as the hull unit 12. If the units 12 and 20 are built at different construction sites, one of the units is transported to the other or both of them are brought to a common assembly site for integration. The propulsion unit 20 is transferred from its building ways or transfer area 80 to a floating dry dock 82 as schematically illustrated in FIG. 3. The propulsion unit 20 is illustrated in solid lines, when positioned in the building ways 80, and is illustrated in fantom lines, when positioned in the dry dock 82. The propulsion unit 20 is then water-borne, not through its floating capabilities, which it does not posses, but through the buoyancy of the dry dock 82. The unit 20 is then transported by dry dock 82 up to a level of juxtaposition with the cargo unit 12, as illustrated in FIG. 4. The buoyancy level of the dry dock 82 is adjusted until the longitudinally extended protuberances 46 on both sides of the propulsion unit 20 are in alignment with the cutout grooves 24 of the side arms 22. The propulsion unit 20 is then moved forward into the stern opening 18 of the hull unit 12 to occupy its position between the side arms 22. The buoyancy level of the dry dock 82 is then lowered until the lower surface 48 of the extension 46 rests on the bottom surface 34 of the groove 24. In this manner, the propulsion unit 20 is fully supported by the cargo unit 12. The concrete filling operation takes place as described heretofore.

As illustrated in the drawings, the vessel 10, when all three basic parts are joined together, forms a streamlined, smoothly flowing hull both in the longitudinal as well as lateral directions of the exterior hull surfaces. The integrated units behave in the water substantially the same as if the ship has been built originally as a single unit, and not as separated units which were thereafter integrated together. The concrete joint is made level with the steel surfaces it joins and when painted in the usual manner, will appear as the same as the two steel areas it joins.

Each individual unit is designed with its ultimate, primary goal in mind, with no real consideration necessary as to whether or not the propulsion unit 20 will be by itself seaworthy. Indeed, it would be normally expected that the propulsion unit 20 would in fact, by itself, not be seaworthy and would in all likelihood assume a very unacceptable floatation attitude, if one were to attempt to float it by itself. This is in direct contra distinction to the commonly known "integrated tug-barge" concept, in which both units are designed to be separately seaworthy, as well as seaworthy in an integrated combination and easily and almost instantly separable.

Thus, the integrated completed ship of the present invention floats in a horizontal attitude, while the propulsion unit 20 might have, for example, due to its weight distribution and "hull" configuration, an attitude of 20 degrees off the horizontal, or even worse, might capsize and float upside down. Additionally, the flat vertical surface of its most forward wall is not designed for independent seaworthiness in contrast to the usual "V" shape of a tug's bow.

The forgoing described preferred embodiment showing a particular ship configuration or type is an exemplary for the purpose of illustrating the principles of the present invention, which are applicable to all kind of ship designs other than the particular one illustrated.

Although the basic hull unit 12 is referred to as a "cargo" unit, this term should be considered broadly to include for example a passenger vessel configuration. Additionally, although it would be expected that the propulsion unit 20 would include at least the basic power plan, power shaft, propellers etc. for powering the vessel 10 through the water, other auxiliary power can be included in one or more of the other units 12 and 30. Additionally, the accommodation/navigation unit 30 could be placed on the cargo unit 12, rather than the propulsion unit 20 and, indeed, the hull 12, the accommodation/ navigation unit 20 or the accommodation/-navigation unit 2 and propulsion unit 30 could be made together at one time in the real life integrated fashion, rather than separately as in the preferred embodiment.

Because many varying and different embodiments may be made within the scope of the inventive concept herein taught, and because many modifications may by made in the embodiments herein detailed in accordance with the descriptive requirements of the law, it is to be understood that the details herein are to be interpreted as illustrative and not in a limiting sense.

I claim:

1. A marine vessel, comprising:

a flotable hull unit having a streamlined side walls exterior and a stern portion with a generally U-shaped cutout extending vertically substantially through the entire stern portion of the hull unit, the U-shaped cutout being formed by a pair of opposing side arms of the stern portion and a vertical wall extending from a top deck of the hull unit to a bottom of the hull unit, each of the side arms of the stern portion having an interior vertical surface, said surface being provided with a longitudinal groove extending substantially along the entire length of the side arm;

a propulsion unit fixedly attachable to the stern portion within the cutout, the hull unit and the propulsion unit forming an integrated unit when attached together, the propulsion unit having a pair of opposing parallel vertical propulsion unit side walls, each of said propulsion unit side walls having a protuberance extending outwardly from each of said propulsion unit side walls along substantially entire length of the propulsion unit side walls, said protuberances being sized and shaped to fit within the grooves formed in the vertical side arms of the stern portion when the propulsion unit is moved into the U-shaped cutout of the hull unit; and wherein a space gap is formed between the hull unit and the propulsion unit when the two units are joined together, said space gap being filled with a self-hardening substance to facilitate secure attachment of the hull unit to the propulsion unit; and an accommodation/navigation unit fixedly attachable to the integrated unit.

2. A marine vessel, comprising:

a flotable hull unit having a streamlined side walls exterior and a stern portion with a generally U-shaped cutout extending vertically substantially through the entire stern portion of the hull unit, the U-shaped cutout being formed by a pair of opposing side arms of the stern portion and a vertical wall extending from a top deck of the hull unit to a bottom of the hull unit, each of the side arms of the stern portion having an interior vertical surface, said surface being provided with a longitudinal groove extending substantially along the entire length of the side arm;

a propulsion unit fixedly attachable to the stern portion within the cutout, the hull unit and the propulsion unit forming an integrated unit when attached together, the propulsion unit having a pair of opposing parallel vertical propulsion unit side walls, ech of said propulsion unit side walls having a protuberance extending outwardly from each of said propulsion unit side walls along substantially entire length of the propulsion unit side walls, said protuberances being sized and shaped to fit within he grooves formed in the vertical side arms of the stern portion when the propulsion unit is moved into the U-shaped cutout of the hull unit;

means for preventing spreading of the side arms of the stern portion during heavy sea condition, said means for preventing spreading comprise bracing rods partially extending into an opening formed in each side wall of the stern portion and partially extending into a co-aligned opening formed in an adjacent facing side wall of the propulsion unit, enclosures secured to decks of the hull unit and the propulsion unit, each enclosure housing respective parts of the bracing rods, said enclosures being filled with a self-hardening material to facilitate secured position of the bracing rods; and an accommodation/navigation unit fixedly attachable to the integrated unit.

3. A marine vessel, comprising:

a flotable hull unit having a streamlined side walls exterior and a stern portion with a generally U-shaped cutout extending vertically substantially through the entire stern portion of the hull unit, a propulsion unit fixedly attachable to the stern portion within the cutout, the hull unit and the propulsion unit forming an integrated unit when attached together, an accommodation/navigation unit fixedly attachable to the integrated unit; and means for securing the accommodation/navigation unit to a deck of the propulsion unit said securing means comprising a horizontal flange extending perpendicularly to vertical walls of the accommodation/navigation unit about an entire periphery of the accommodation/navigation unit, and L-shaped bar fixedly attached to the deck of the propulsion unit at a discrete distance from the horizontal flange to form a space gap, said space gap being filled with a self-hardening substance.

4. A marine vessel, comprising:

a floatable hull unit having a streamlined side walls exterior and a stern portion, said stern portion being provided with a generally U-shaped cutout extending vertically substantially through the entire hull unit, the U-shaped cutout being formed by a pair of opposing side arms of the stern portion and a vertical wall extending from a top deck of the hull unit to a bottom of the hull unit, each of the side arms having an itnerior surface which is provided with a longitudinal groove extending substantially through an entire length of the interior surface a distance from the top deck of the hull unit;

an independently non-floatable propulsion unit fixedly attachable to the stern portion within the U-shaped cutout of the hull unit, said propulsion unit having a periphery about at least a part of the exterior of the propulsion unit sized and shaped to fit within the U-shaped cutout of the hull unit, said propulsion unit further having a pair of opposing parallel vertical propulsion unit side walls, each of the propulsion unit side walls having a protuberance extending outwardly from the propulsion unit side walls along substantially entire length of the propulsion unit side walls, the protuberances being sized and shaped to fit within the grooevs formed in the vertical side arms of the stern portion, when the propulsion unit is moved into the U-shaped cutout of the hull unit; and an accommodation/navigation unit fixedly attachable to the propulsion unit; and wherein a space gap is formed between the hull unit and the propulsion unit when the two units are joined together, said space being filled with a self-hardening substance to facilitate secure attachment of the hull unit to the propulsion unit.

5. The apparatus of claim 4, further comprisign means for preventing spreading of the side walls of the stern portion during heavy sea conditions, said means comprising bracing rods partially extending into an opening formed in each side wall of the stern portion and partially extending into a co-aligned opening formed in an adjacent facing side wall of the propulsion unit, enclosures secured to decks of the hull unit and the propulsion unit, each enclosure housing respective parts of the bracing rods; said enclosure being filled with a self-hardening material to facilitate secure positioning of the bracing rods.

6. The apparatus of claim 5, wherein said vessel further comprsies means for securing the accommodation/navigation unit to a deck of the propulsion unit.

7. The apparatus of claim 6, wherein said securing means comprise a horizontal flange extending perpendicularly form vertical walls of the accommodation/-navigation unit about an entire periphery of the accommodation/navigation unit, an L-shaped bar fixedly attached to the deck of the propulsion unit at a discrete distance from the horizontal flange to form a space gap, said space gap being filled with a selfhardening material.

* * * * *